United States Patent [19]

Resler, Jr.

[11] 4,453,502

[45] Jun. 12, 1984

[54] COMBUSTION CONTROL BY PRESTRATIFICATION

[75] Inventor: Edwin L. Resler, Jr., Ithaca, N.Y.

[73] Assignee: Cornell Research Foundation, Inc., Ithaca, N.Y.

[21] Appl. No.: 456,143

[22] Filed: Jan. 6, 1983

Related U.S. Application Data

[63] Continuation of Ser. No. 163,898, Jun. 27, 1980, abandoned, which is a continuation of Ser. No. 140,932, Apr. 16, 1980, abandoned.

[51] Int. Cl.[3] ..... F02B 17/00; F02B 27/08; F02M 25/06

[52] U.S. Cl. ..... 123/1 R; 123/1 A; 123/568; 123/574; 123/430

[58] Field of Search ..... 123/568, 574, 1 A, 1, 123/430

[56] References Cited

U.S. PATENT DOCUMENTS

| | | | |
|---|---|---|---|
| 2,652,040 | 3/1981 | Tritt | 123/568 |
| 3,092,988 | 6/1963 | Goossak et al. | 123/41.31 |
| 3,283,751 | 11/1966 | Goossak et al. | 123/430 |
| 3,799,130 | 3/1974 | Dahlstrom | 123/568 |
| 3,810,454 | 5/1974 | Hunt | 123/430 |
| 4,104,988 | 8/1979 | Resler, Jr. | 123/430 |
| 4,119,074 | 10/1978 | Hattori | 123/568 |
| 4,135,481 | 1/1979 | Resler, Jr. | 123/568 |
| 4,261,316 | 4/1981 | Motosugi et al. | 123/568 |
| 4,262,639 | 4/1981 | Motosugi et al. | 123/52 M |
| 4,413,593 | 11/1983 | Resler, Jr. | 123/568 X |

OTHER PUBLICATIONS

Datsun Discovery, vol. 3, No. 3, pp. 29–30, Fall, 1979.
Cornell Engineer, vol. 45, No. 1, Oct. 1979.
Road Test, pp. 32–34, Dec. 1979.

*Primary Examiner*—Wendell E. Burns
*Attorney, Agent, or Firm*—Jones, Tullar & Cooper

[57] ABSTRACT

Combustion control in a spark ignited internal combustion engine for inhibition of incipient detonation, or knock, is provided by the addition of exhaust gases or other diluent gases to the intake manifold of the engine prior to opening of the intake valve. The addition of this diluent gas causes a prestratification of the charge entering the combustion chamber of the engine. Upon compression and ignition of the charge, the diluent gas inhibits spontaneous combustion of the portions of the charge furthest away from the site of ignition of the charge, thereby preventing one cause of incipient detonation. This combustion control allows the engine to operate on much lower octane fuel than would be possible without prestratification.

17 Claims, 1 Drawing Figure

COMBUSTION CONTROL BY PRESTRATIFICATION

This is a continuation of application Ser. No. 163,898, filed June 27, 1980; which was a continuation of Ser. No. 140,932, filed Apr. 16, 1980, both now abandoned.

FIELD OF THE INVENTION

The present invention is directed generally to the control of combustion in a spark ignition internal combustion engine. More particularly, the present invention is directed to combustion control by the use of charge prestratification. More specifically, the present invention is directed to combustion control by exhaust gas prestratification of the charge in the intake manifold. Most particularly, the present invention is directed to combustion control of a spark ignition internal combustion engine by exhaust gas charge prestratification whereby the prestratified charge in the portion of the cylinder away from the spark source is rendered much less apt to combust spontaneously, thereby eliminating knock.

In accordance with the invention, exhaust gas or other diluent gas is continously or intermittantly introduced under pressure into the intake manifold of an engine at a location generally adjacent the intake port of a cylinder to selectively dilute the charge which is to be inducted into the cylinder on the intake stroke. The charge in the intake manifold may be an air-fuel mixture in the case of a carbureted engine, and in the case of a fuel injected engine may be an air-fuel mixture or air only, depending on the fuel injector location. While the intake valve is closed, the gas dilutes the portion of the charge which is located in the region of the intake port to form a pocket of diluted charge adjacent the port and to prestratify the charge. Upon opening of the intake valve, the accumulated diluted charge is admitted into the engine cylinder first and is followed by the undiluted portion of the charge to produce a stratified charge in the cylinder. The prestratification of the charge in the intake manifold, and the maintenance of that stratification within the cylinder allows the engine to operate efficiently without ping or knock and to operate on fuel having a substantially lower octane rating than would be possible without the combustion control by prestratification in accordance with the present invention.

DESCRIPTION OF THE PRIOR ART

The efficiency of an internal combustion engine operating on the Otto cycle is dependent, to a large degree, on the compression ratio of the engine. However, as is apparent to most automobile drivers, the use of low octane fuel in a high compression engine produces what is commonly called knock or ping. This knock can be caused by the premature spontaneous combustion of a portion of the charge in the cylinder of a engine and can, if permitted to continue, destroy the engine.

Until relatively recently, the octane ratings of gasoline were increased by the addition of fuel additives such as tetra-ethyl lead and the like to permit their use in high compression engines. Recent pollution control requirements have eliminated the use of such octane improving additives, however, and the automotive industry has been required to rely on lower compression ratio engines which will operate on the lower octane rating unleaded gasolines currently being refined. The use of lower compression ratios has produced less efficient engines, which have not been readily accepted by the driving public. Furthermore, the increased refining costs associated with the production of unleaded gasoline having a sufficiently high octane rating to perform in currently available high compression engines have been passed on to the consumer. These increased production costs, together with the increasing costs of crude oil and its questionable availability, have substantially raised the cost of gasoline and have given added impetus to the search for alternate fuels and to methods for using available fuels more efficiently.

In response to the drive to reduce air pollution, the present day conventional internal combustion engine has been subjected to a number of restrictions which have required the addition of "bolt on" hardware, which is aimed at reducing chemical pollutants produced during operation. Such devices as catalytic converters, air pumps, exhaust gas recirculation, and the like, have been added to the basic engine. The inventor herein has been active in the field of pollution reduction for internal combustion engines and has several patents directed to prestratification of engine charges for this purpose. U.S. Pat. Nos. 4,104,989 and 4,135,481, both describe the introduction of a gas into the intake manifold of the engine at a point between the throttle valve and the intake valve. This gas acts to prestratify the charge prior to its entry into the working cylinder for the purpose of reducing the pollution emitted by the engine.

The prior art also teaches that exhaust gas recirculation (EGR) may be applied to engines for pollution control by introducing exhaust gases into the intake manifold at a point directly below the throttle plate of the carburetor. This exhaust gas recirculation causes uniform dilution of the air-fuel mixture. Such EGR systems are disclosed in U.S. Pat. Nos. 3,625,189 to Myers; 3,809,039 to Alqeust; 3,980,618 to Tange et al.; and 3,941,105 to Yagi et al.

Since pollution control remains an important factor in internal combustion engine design, the expense of refining fuels having an octane rating sufficiently high to permit use in high compression engines has led to a reduced availability of such fuels, and has created a serious problem for the users of these engines. The problem is particularly acute for users of aviation gasoline, which is becoming scarce in remote areas. Aircraft engines, particularly those in smaller aircraft, are high compression, and do not operate well on low octane fuels. However, in many areas, the only fuel available is kerosene, which is suitable for jet aircraft engines, but is not usable in conventional internal combustion engines. Although many attempts have been made to find a way to operate conventional high compression engines on low octane fuel, this has not been accomplished successfully in the prior art.

Thus, the current state of the art of spark ignition internal combustion engines is restricted by the interraction of octane ratings of the fuel available and the limit this rating places on compression ratios which will accept this fuel without knock. Increased fuel combustion efficiencies require increased compression ratios, but limitations on the octane rating of the fuels which can reasonably be refined place an upper limit on compression ratios. Alternate fuels, such as coal oil or kerosene, are of such a low octane rating that they cannot be used in the internal combustion engines currently available. Accordingly, a solution is sought which will allow the use of currently available gasoline in higher compression ratio engines or which will allow the use of low octane fuels, which could be produced from domestic resources such as coal or oil shale, in engines currently in use or being produced.

SUMMARY OF THE INVENTION

It is an object of the present invention to control combustion in a spark ignition internal combustion engine.

Another object of the present invention is to control combustion by prestratification of the charge prior to its delivery to the cylinder.

A further object of the present invention is to utilize exhaust gas to prestratify the charge prior to introduction of the charge into the cylinder, to obtain a controlled combustion within the cylinder.

Yet another object of the present invention is to improve the efficiency of the engine by charge prestratification.

Still a further object of the invention is to reduce the octane rating of the fuel required by the engine through charge prestratification.

It is also an object of the present invention to inhibit knock or ping through combustion control by charge prestratification.

As will be discussed in greater detail hereinafter in the description of a preferred embodiment, combustion control in a spark ignition internal combustion engine is accomplished in accordance with the subject invention by prestratification of the charge to the cylinder prior to its introduction into the cylinder. In the preferred embodiment, this prestratification is accomplished by the introduction of diluent exhaust gas into the intake manifold at a point adjacent the intake valve. While this valve is closed, the exhaust gas accumulates in the region of the intake port, and dilutes the portion of the charge in the manifold. Upon opening of the intake valve, this is the first portion of the charge inducted into the cylinder. The remaining portion of the charge is then inducted through the intake manifold to complete the charge, and the charge is compressed and ignited. The charge thus is stratified in the intake manifold by the introduction of the exhaust gas or other diluent prior to its induction into the cylinder, and remains essentially stratified in the cylinder during compression and combustion.

The diluted portion of the charge, containing the exhaust gas, flows into the cylinder first, and is deposited at a location furthest away from the spark plug, generally adjacent the piston. This portion of the combustion chamber usually contains the end gases which are the most subject to incipient detonation or knock. By using prestratification with exhaust gas or other diluent gases in accordance with the present invention, the end gases are prevented from burning until the flame front created by the spark ignition reaches them, and the tendency of the engine to knock is eliminated or substantially reduced.

As was discussed previously, since efficiency is related to compression ratio, and since higher compression ratios provoke knock, reduction of the octane ratings of available fuel has created a serious problem in existing engines. However, the combustion control by prestratification, in accordance with the present invention, permits two interrelated solutions to this problem. First, by use of the invention, the compression ratio of an engine can be increased while still operating on available octane rating gasoline. Since the engine efficiency is increased, the result is better utilization of the fuel. Second, and alternatively, with the invention the compression ratio of the engine is not altered, but the octane requirement of the fuel used in the engine is substantially reduced. Thus, a low octane fuel, such as kerosene or coal oil, can be utilized in a readily available engine which has been fitted with the charge prestratification of the present invention. Since domestic supplies of coal and oil-bearing shale are large, the application of combustion control by prestratification, in accordance with the present invention, would result in a significant reduction on the dependence on other than domestic energy sources.

In brief, then, in a preferred form the present invention is directed to a method of controlling incipient detonation and increasing the efficiency of combustion in an internal combustion engine by prestratification of the charge in such a way that a low octane fuel may be used in an engine having a compression ratio which exceeds the "permissible compression ratio" of the fuel. This is accomplished in a carbureted engine by supplying a fuel-air mixture to the intake manifold of an engine at a first pressure, the fuel having an octane rating which would normally not be operable in the engine without incipient detonation. A diluting gas, such as recirculated exhaust gas, is fed to the intake manifold at a location near the intake port, or intake valve, of the engine. This diluting gas is at a second pressure higher than the pressure of the fuel-air mixture, so as to dilute the fuel-air mixture in the region of the intake port. With the intake port closed, a pocket of diluted fuel-air mixture is formed which, with the undiluted fuel-air mixture in the portion of the intake manifold remote from the intake port, produces a prestratified charge for the engine.

When the intake valve opens, the prestratified charge is fed into the cylinder during the intake stroke. The diluted portion of the charge enters first and is located near the face of the piston. The undiluted portion of the charge follows, and completes the cylinder charge, but the stratification remains intact.

Ignition occurs after closure of the intake valve and after the compression stroke, producing a flame front which moves through the cylinder, from the spark plug toward the diluted portion of the charge (or end gas). Because of the dilution of the end gas, it will burn only when the flame front reaches it, thus preventing the premature ignition due to the pressure rise caused by the advancing flame front that is the usual characteristic of low-octane fuels, and thereby preventing the incipient detonation associated with the use of these low-octane fuels.

The same principle may be applied to fuel-injected engines, wherein the fuel is injected into the intake manifold, usually near the intake port, when required. In this case, the undiluted portion of the charge may simply be air, and the diluted portion may be an air-exhaust gas mixture, with the fuel being added to the charge as needed while it is being inducted into the cylinder.

Although the present disclosure refers to the prestratification process in terms of the pressure of the normal portion of the charge with respect to the pressure of the diluent supplied to the diluted portion, it will be understood that this is for convenience in describing the relative quantities of the diluted and undiluted charge, and that other measures of quantity, such as the relative volumes of the respective charge portions, could be used. It should also be noted that the diluent gas may be supplied continuously or intermittently. If the former, then a portion of diluent gas will also be added to the normal portion of the charge, although not in the amount supplied to the diluted portion, and not in sufficient quantity to adversly affect the combustibility of the normal portion of the charge.

Combustion control by prestratification has the immediate effect of eliminating the knock or ping in present spark ignition engines which is due to incipient detonation. More importantly, combustion control by prestratification allows an increase in engine compression ratios and hence efficiency without increasing the octane rating requirements of the engine, thus more effectively utilizes existing fuels. Additionally, by eliminating knock, the present invention will allow the utilization of domestically available fuels, such as coal oil or kerosene, in presently produced engines, thereby reducing dependence on foreign oil supplies and reducing refining costs.

BRIEF DESCRIPTION OF THE DRAWINGS

While the patentable features of the control of combustion by prestratification are set forth with particularity in the appended claims, a full and complete understanding of the foregoing objects, features, and advantages of the invention may be had by referring to the description of a preferred embodiment as set forth hereinafter and to the accompanying drawing in which the sole FIGURE is a schematic view, partly in section, of an engine employing combustion control by prestratification in accordance with the present invention.

DESCRIPTION OF A PREFERRED EMBODIMENT

Figure 1:
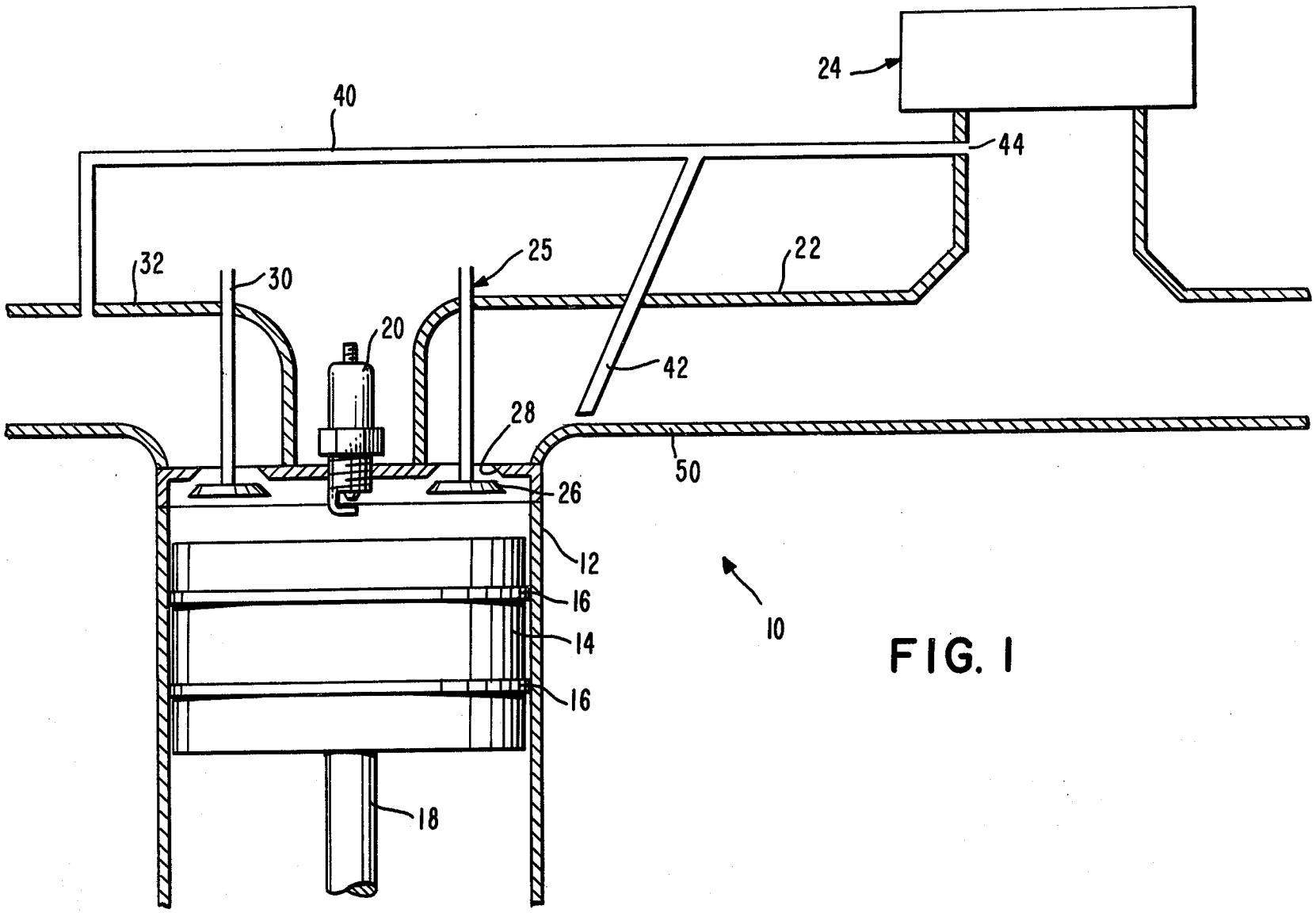

In internal combustion engines, fuel combustion characteristics act to dictate some of the engine's operating parameters. These parameters can be affected by appropriate dilution of the combustible air-fuel mixture with air, exhaust gases, or other diluent gases. In the past, such effect was directed to affecting the combustion process with fuel additives such as tetra-ethyl lead for control of knock, the use of special fuel blends for winter and summer, or for geographic location, and the like. The present invention is directed to the use of prestratification to effect the control of what is commonly referred to as "knock" or "detonation" in internal combustion engines without the need for such additives or special blends.

Two compression ratios characterize any given fuel and dictate its usefulness in engine applications. The first is the "critical compression ratio", or C.C.R., which is the minimum compression ratio necessary for the air-fuel mixture to burn spontaneously. For 60 octane gasoline, the C.C.R. is about 11 and for 80 octane gasoline about 14. For methane the C.C.R. is greater than 15 while for kerosene the C.C.R. is about 7.5. In spark ignition engines, the second compression ratio of interest is the "permissible compression ratio", or P.C.R., (sometimes refered to as the "highest useful compression ratio" or H.U.C.R.), which for a given fuel is limited by the onset of "knock", or uncontrolled combustion leading to an undesirable pressure rise rate, this rate being sufficiently fast to generate a noise described as a "ping" and labeled "incipient detonation." The P.C.R. is always lower than the C.C.R. and limits the compression ratio of the engine operating with that fuel. Since engine efficiency is determined by the compression ratio, in which, for the ideal Otto cycle, the efficiency $\eta=1-1/(CR)^{\gamma-1}$ where $\gamma$ is the ratio of the specific heat at constant pressure Cp to that at constant volume Cv, $\gamma=Cp/Cv$, this limitation of the compression ratio, and thus of engine efficiency, is not desirable. The P.C.R. depends on a multitude of operating parameters but for present day gasoline a P.C.R. of 8, for kerosene a P.C.R. of 5, and for methane a P.C.R. of 8 can be adopted. If an engine could be operated at its C.C.R. rather than its P.C.R., an increase in efficiency would result.

The P.C.R. is less than the C.C.R. since the last gases to be burned (end gas) by the flame front initiated by the ignition source (spark plug) are compressed not only by the piston during the compression stroke of the engine but also by expanding gases that have burned on passing through the flame front prior to the arrival of the flame front at the end gas. This occurs because, the rate of propagation of the flame front, which is determined by temperature gradients, heat conductivity, and heat capacity in the flame front, is less than one-tenth the sound speed in the gas, which determines the rate at which pressure is equalized. Accordingly, the combustion process across the front is essentially one of constant pressure, and the pressure rises uniformly throughout the combustion chamber as the flame front advances into the unburned mixture. The gas ahead of the flame front is compressed isentropically by the piston motion and also by the gas engulfed in the advancing flame front so that the end gases which are subjected to the greatest pressure and temperature rises before combustion and during the engine cycle will be the first to self-ignite. As the compression ratio of the engine is increased, the liklihood of self-ignition of the end gases increases. Thus, if the end gas temperature can be reduced by selected dilution so as to prevent premature self-ignition, "knock" will be controlled and more efficient engines made possible.

To discuss this process quantitatively, certain properties of engines operating on the ideal Otto cycle will be derived. Consider an advancing flame front progressing into unburned gases, b, behind which are burned gases, a.

| flame front → | |
|---|---|
| a burned | b unburned |

The internal energy U is made up of Ua and Ub and if one assumes perfect gases so Ua=MaCvTa where Ma is the mass of a, and Ta is the temperature of a, then $U=Ua+Ub=MaCvTa+MbCvTb$.

Since the pressure p is unform throughout the chamber, $Pa=Pb=p$ where $Pa=MaRTa/Va$ and $Pb=MbRTb/Vb$ and the volume V is $V=Va+Vb$, so $$U = Cv\left[\frac{PaVa}{R} + \frac{PbVb}{R}\right] = \frac{Cv}{R}[PaVa + PbVb]$$

$$U = \frac{Cv}{R}p(Va + Vb) = \frac{Cv}{R}pV,$$

where R is the gas constant. In the ideal cycle it will be assumed that heat is added at constant volume, so that the flame front traverses the gas while the piston is essentially at top dead center (T.D.C.). From the first law of thermodynamics, $Q=\Delta U-\delta W$ where Q is the total heat added and $\delta W$ is the work done. Since $\delta W=-pdV=0$, then $Q=\Delta U=(Cv/R)V\Delta p$, using the expression for U above.

Thus the pressure rise in all cases depends only on the heat added when V is constant. This result can be extended to include multiple gases, rates of heat release, or layers with varying composition and in all cases the result is the same. Because the pressure rises uniformly in the chamber, the pressure rise is always proportional to the heat released at constant volume. Since the cyle work W is the efficiency $\eta$ multiplied by the heat added Q from burning the fuel, and since the efficiency depends only on the compression ratio CR, then for a given work or engine power output the heat added should always be the same overall regardless of the details of the combustion process or processes in this idealized case of heat addition at T.D.C. Therefore, the total pressure rise $\Delta p$ due to combustion should also be the same.

The pressure rise experienced by the very last end gas, which is the pressure rise due to the compression stroke plus the pressure rise due to the advancing flame front, can be calculated. If the end gas temperature is $T_e$, and $p_c$ is the pressure at the end of the compression stroke, and if $p_o$ is the inlet or manifold pressure and $T_o$ the inlet temperature, then $$\frac{Te}{To}=\left[\frac{p_c+\Delta p}{p_o}\right]^{\frac{\gamma-1}{\gamma}}$$

Using the previously derived relation between heat added and pressure rise for complete combustion, where Q is the total heat added, and q is the heating value of the fuel per unit mass, Q=fuel mass $$\frac{\text{heat release}}{\text{(fuel mass)}}=\{\rho_o Vo\}\frac{F}{A}q=\frac{Cv}{R}V\Delta p\left(1+\frac{F}{A}\right)$$

where Vo is the engine cylinder volume and $p_o$ the intake density and F/A is the fuel-air ratio. Since $CR=Vo/V$ and $p_o=\rho_o RTo$, then:

$$\left(\frac{PoVo}{RTo}\right)\frac{F}{A}q=\frac{Cv}{R}\frac{Vo}{(CR)}\Delta p\left(1+\frac{F}{A}\right) \text{ or}$$

$$\Delta p=\frac{(CR)}{\left(\frac{A}{F}+1\right)}\left(\frac{q}{CvTo}\right)p_o$$

The $C_v$ used here for combustion should be about $C_v$=0.25 BTU/Lb.°R.

The heating value of hydrocarbon fuels is about 18000 BTU/Lb. and the air-fuel ratio at equivalence ratio $\phi=1$ is about 15 (A/F=15) so that q, or heat released on combustion per pound of fuel is 18000 BTU/Lb. and $q/C_v(1+A/F)=4500°$ R.$=\Delta T_c$ where $\Delta T_c$ is the temperature change in the combustion chamber on constant volume combustion. If we arbitratily choose $T_o$ equal to 80° F. or 540° R., then $$\Delta p=\frac{CR}{16}\frac{18000}{(0.25)(540)}p_o=(CR)(8.33)p_o$$

These above derived formulas can now be utilized in a specific example. Consider an engine which operates on kerosene at a compression ratio of 5 and a manifold or inlet pressure (assuming no charge dilution from the previous cycle) of $p_o$, then using $\Delta p=(CR)(8.33)\ p_o$ yields a $\Delta p$ of 41.67 $p_o$ and using $$\frac{Te}{To}=\left[\frac{p_c}{p_o}+\frac{\Delta p}{p_o}\right]^{\frac{\gamma-1}{\gamma}} \text{ yields } \frac{Te}{To}=[(CR)^{\gamma}+41.67]^{\frac{\gamma-1}{\gamma}}$$

If $\gamma=1.4$ then Te/To=3.08 or Te=1662° R.=1202° F., since To was assumed to be 80° or 540° R.

For the same engine, operating on kerosene at a compression ratio of CR*, but changing $p_o$ to $p_o$* by means of exhaust gas dilution, while keeping the same $T_o$, $T_e$, W and $V_o$ for the same knock performance at the same power, then:

$$W=\eta Q=\eta^* Q^* \text{ or } \eta p_o(F/A)=\eta^* p_o^*(F/A)^*$$

and $$P_c^*/p_o^*=(CR^*)^{\gamma}$$

so $$\left[(CR^*)^{\gamma}+\frac{(CR^*)q/CvTo}{\frac{A}{F}\frac{\eta^*}{\eta}\frac{p_o^*}{p_o}+1}\right]^{\frac{\gamma-1}{\gamma}}=3.08$$

From the foregoing it is seen that $$\frac{p_o^*}{p_o}=\frac{\eta}{\frac{A}{F}\eta^*}\left[\frac{133.33\ CR^*}{51.19-(CR^*)^{\gamma}}-1\right] \quad \text{if } \gamma=1.4$$

Where $p_o$* is the intake manifold pressure that should be achieved by selective dilution of the charge for prestratification to obtain the same power and knock performance (i.e., the same temperature of the end gas) for different chosen compression ratios, CR*. Thus with the same knock restriction the engine can be operated at a higher CR, and thus with higher efficiency, if $p_o^*/p_o$ is made larger than 1. For example, for various ratios of exhaust gas dilution, the following compression ratios are attainable with the resulting efficiencies $\eta^*$ for kerosene:

TABLE I

| $p_o^*/p_o$ | CR* | n* |
|---|---|---|
| 1 | 5 | 0.47 |
| 1.21 | 6 | 0.51 |
| 1.46 | 7 | 0.54 |
| 1.77 | 8 | 0.56 |

These results indicate that by increasing the intake manifold pressure to a level above that of a conventionally aspirated engine by the addition of recirculated exhaust gas or other diluent gases to the intake manifold so that the ratio $p_o^*/p_o$ is increased to 1.77 a fuel such as kerosene can be used in an engine having a compression ratio of 8 and with a resulting efficiency of 0.56, whereas previously such a fuel could only be operated in an engine having a compression ratio of 5. Thus, the addition of exhaust gas to cause dilution of the end gases and to thereby control combustion and eliminate or severely inhibit knock will allow the use of a fuel such as kerosene having a P.C.R. of 5 to be used in an engine having a compression ratio of 8 if sufficient exhaust gas dilution in the form of charge prestratification is applied to increase the intake manifold pressure to about twice its conventional level.

The ratio of manifold pressures $p_o^*/p_o$ is utilized in this calculation as it is a readily detectable indication of the amount of exhaust gas being added to the charge, but the amount of diluent added could be determined in other ways; for example by measurement of, and control of, the volume of diluent gas added to the charge. It should be remembered that the diluent gas is used to control combustion by prestratification so that the charge introduced into the cylinder is added in a stratified configuration.

Utilizing the same formulas as discussed above for gasoline which will operate in a conventional engine having a compression ratio of 8 when $p_o^*$ is equal to $p_o$, yields the following:

$$\Delta p = 66.67 p_o$$

$$Te/To = 3.56 \text{ or } Te = 1922° \text{ R. or } 1462° \text{ F.}$$

By raising the ratio $p_o^*/p_o$ through the addition of exhaust gas prestratification to the intake manifold, the following values can be calculated:

TABLE II

| $p_o^*/p_o$ | CR* | n* |
|---|---|---|
| 1 | 8 | 0.56 |
| 1.76 | 12 | 0.63 |
| 3.22 | 16 | 0.67 |

These calculations indicate that by prestratification through the addition of exhaust gas to the intake manifold, the gasoline could be burned in an engine with a compression ratio approaching 16 if the manifold intake pressure were tripled by the addition of sufficient exhaust gas diluent. This compression ratio, and hence the efficiencies of diesel engines, can thus be obtained from a spark ignition internal combustion engine through the control of combustion by prestratification caused by the addition of exhaust gas to the intake manifold in a sufficient amount and at the proper location.

To verify the above calculations, tests were run on a 258 cubic inch American Motors Corporation 6-cylinder engine having a compression ratio of 8. Recirculated exhaust gas was utilized to prestratify the charge before it entered the combustion chamber in such a manner that the end gases, which in this engine are those closest to the piston head and farthest away from the spark plug, received the portion of the charge which had been diluted by the exhaust gas. Ordinarily, increasing the intake manifold pressure with exhaust gas for conventional EGR pollution control is restricted to about a 10% increase. However, it has been found that because unburned gas in the combustion chamber is preheated by the flame front, as described above, its tolerance for exhaust gas is increased, and the prestratification of the present invention can be used to make $p_o^*/p_o$ much greater than 1.10.

With the timing set at 10° before top dead center, the engine was run using such fuel as kerosene, Jet A, JP-4, etc. The octane rating for this fuel is quite low, generally in the range of 40, so that the permissible compression ratio for kerosene in a conventional engine is in the range of 3.5 to 5.5.

By using combustion control by prestratification with exhaust gas the following readings were noted. The conventional values using gasoline and no prestratification are shown in parenthesis.

| Speed | Intake Manifold Pressure Inches of Mercury | M.P.G. | $p_o^*/p_o$ |
|---|---|---|---|
| 25 MPH | 25.5 (14.5) | 26 (24) | 1.76 |
| 50 MPH | 24 (16.5) | 24 (21) | 1.45 |

The engine was observed to run smoothly and quietly at 25 MPH with no audible indication of ping or knock. The ratio of $p_o^*/p_o$ compares with the calculated values set forth previously in Table I for Kerosene. At speeds above 50 MPH the onset of knock could be detected. This was explained by the fact that at this speed the ratio of $p_o^*/p_o$ was reduced to 1.45, thus indicating the availability of less exhaust gas diluent for charge prestratification, and from Table I it can be seen that such a ratio requires a lower compression engine. This test demonstrated that a conventional gasoline engine can be caused to operate satisfactorily on kerosene, or other low octane fuels, by the use of combustion control by prestratification with exhaust gas in accordance with the present invention. The above considerations can be made generally for any desired set of paramenters giving $$\frac{p_o^*}{p_o} = \frac{\eta PCR}{\eta^*(A/F)PCR}\left[\frac{CR^*(q/CvTo)}{(PCR)\frac{q}{CvTo}\frac{1}{\left(\frac{A}{F}+1\right)_{PCR}} + (PCR)^\gamma - (CR^*)^\gamma} - 1\right]$$

Referring now to FIG. 1, there is illustrated a first embodiment of a spark ignition internal combustion engine 10 utilizing prestratification by exhaust gas for combustion control to eliminate knock or incipient detonation in accordance with the present invention. FIG. 1 is a schematic illustration of only a portion of one cylinder of the engine, and it will be understood that this engine is generally conventional in structure except for the prestratification feature of the invention.

Engine 10 includes a cylinder 12 in which is carried a reciprocating piston 14. Piston 14 carries known compression sealing rings 16 and transmits power through a connecting rod 18 to the crankshaft of the engine (not shown). A spark plug 20 is secured in the upper portion of the cylinder and functions in a conventional manner to ignite a charge of fuel and combustible gas compressed in the cylinder 12 by reciprocation of the piston 14. It will be understood that the disclosed engine operates on the well known Otto cycle.

The charge is fed into the cylinder 12 through an intake manifold 22. This charge may, for example, be air and fuel mixed in a conventional carburetor 24 secured to the intake manifold or may be air into which fuel is injected at a suitable location, such as adjacent the intake value, the particular manner in which the fuel and air are mixed not being a part of this invention. An intake valve 25 is mounted in the intake manifold and has a valve head 26 which cooperates with an intake port 28 in the top of cylinder 12 to control flow of combustion materials into cylinder 12 from intake manifold 22 in a conventional manner. An exhaust valve 30 is also provided in the cylinder and opens to allow a flow of combustion products in the form of exhaust away from the cylinder through an exhaust manifold 32. The above described engine normally operates with gasoline and air, and the fuel and air mixture usually is supplied at a ratio of generally about 1 to 15.

It will be understood that the working gas used in the present invention is generally air, and for convenience the mixture supplied in this embodiment by the carburetor will be referred to as a fuel-air mixture, but any combustion supporting gas can be used. In addition, while only one cylinder has been set forth, it will be understood that this is only for purposes of illustration and that the engine may well have a number of similar cylinders all of the same configuration and all in communication with the above disclosed intake and exhaust manifolds 22 and 32, respectively, and with the carburetor 24. Further, while the diluent gas will be described and for convenience referred to herein as exhaust gas, it will be understood that dilution of the charge for prestratification can be accomplished by other gases, such as air, for example.

As discussed above and as shown in FIG. 1, combustion control by prestratification through exhaust gas dilution is accomplished in the present invention by the provision of an exhaust gas recirculation line 40 which takes a portion of the exhaust gases from the exhaust manifold 32 and returns the portion to an exhaust gas prestratification port or nozzle 42. If desired, additional exhaust gas may be fed to a conventional exhaust gas recirculation system through an E.G.R. port 44 adjacent the throttle valve of carburetor 24.

As may be seen in FIG. 1, the exhaust gas prestratification nozzle 42 extends into the intake manifold 22 at a point generally adjacent the intake valve 25. In a preferred embodiment, the prestratification nozzle 42 is so positioned that it will be angled with regard to a lower surface portion 50 of the intake manifold where a layer of liquid fuel tends to form. This positioning of port 42 allows the recirculated hot exhaust gas to vaporize this accumulation of fuel in the manifold.

The size of the exhaust gas prestratification nozzle 42, and thus the flow of exhaust gas, and its exact location will vary with engine configuration. The size is selected in accordance with the amount of exhaust gas prestratification desired and the increase in intake manifold pressure needed for combustion control. The intake manifold pressure is normally governed by the carburetor and manifold construction and the fuel-air mixture normally is carried in the manifold at a given first pressure. By the addition of exhaust gas diluent at a second higher pressure, the net pressure in the intake manifold will be increased. As discussed previously, this pressure ratio is an indication of the amount of exhaust gas for prestratification being used for combustion control.

In operation, after the intake valve 25 has closed there remains a quantity of the fuel-air mixture from the carburetor in the intake manifold. Exhaust gas is fed into the nozzle 42 from the exhaust manifold 32 to dilute the portion of the fuel-air mixture remaining in the portion of the intake manifold 22, which is near the now closed intake valve 25. As discussed previously, the exact amount and pressure of the exhaust gas used for this charge prestratification will vary, depending on engine configuration and the fuel being used. The injected exhaust gas vaporizes a portion of the liquid fuel on the lower surface 50 of the manifold, and in addition, creates a pocket or region adjacent the intake valve in which the fuel-air mixture is diluted by the exhaust gas, the remaining portion of the fuel-air mixture being substantially undiluted. This pocket is diluted fuel-air mixture cooperates with the undiluted mixture to produce a prestratification of the charge which is to be delivered to the cylinder.

As the intake valve 25 opens and piston 14 travels downwardly on its intake stroke, the diluted mixture of fuel, air, and exhaust is drawn into the cylinder as the first portion of the cylinder charge occupying the region of the cylinder 12 farthest from spark plug 20 and generally in the region of piston 14. The remainder of the charge is formed by the substantially undiluted fuel-air mixture drawn from the carburetor. It will be noted that the fuel-air mixture from the carburetor is drawn past the prestratification nozzle 42, and thus will receive some diluent gas, in an amount which is allowed for in the design of port 44 and/or nozzle 42. This substantially undiluted portion of the charge enters the cylinder and is located in the portion thereof which is closer to the spark plug 20. After the intake valve closes and while the charge in the cylinder is compressed during the compression stroke, the charge remains generally in the prestratified condition in which it was admitted to the cylinder.

Upon ignition by the spark plug, a flame front is created in the charge adjacent the plug and moves substantially uniformly outwardly. As was discussed previously, the compression stroke of the piston together with combustion of the charge in the cylinder causes a pressure rise in the yet unburned portions of the charge in the cylinder which, with fuels having a relatively low octane rating, would normally cause incipient detonation of the end gases; i.e., the portion of the charge located in those regions of the cylinder furthest away from the spark plug. However, because of the dilution of the end gases by prestratification, these gases will not support combustion in the absence of a flame, and thus they will not tend to detonate under the increased pressure created by the flame front and by the compression stroke of the cylinder. Accordingly, incipient detonation, or knock, is prevented and the complete charge combusts properly.

After combustion, the exhaust valve 30 is opened and the combusted products are exhausted, a portion of these exhaust gases being returned to the intake manifold adjacent the intake valve 25 through the exhaust gas prestratification port 42 and the remainder of the exhaust gases passing into the atmosphere.

While the combustion control by prestratification using exhaust gas in accordance with the present invention has been set forth for use in a carburated reciprocating piston engine, it will be obvious that such combustion control could also be utilized in other engine configuration such as rotary, and could be used with fuel injection. Further, as was discussed previously, the exact location of the prestratification port 42, the pressure of the exhaust gases required to prestratify the charge, and hence, the specific size and shape of the exhaust gas prestratification nozzle will vary in a response to engine configuration and the fuel to be burned. Furthermore, while a preferred embodiment of an engine employing combustion control by prestratification using exhaust gas has been herein above fully and completely disclosed, it will be obvious to one of ordinary skill in the art that a number of changes in, for example, the structure of the intake and exhaust manifolds, the number of engine cylinders, the type of carburation used and the like could be varied without departing from the true spirit and scope of the invention and that the invention is to be limited only to the appended claims.

I claim:

1. A method of controlling detonation in internal combustion engines working in the Otto cycle, to permit use of low octane fuel in such internal combustion engines having a compression ratio exceeding the permissible compression ratio of the fuel, whereby the engine efficiency is improved, comprising:

supplying a charge to the intake manifold of an internal combustion engine, said charge utilizing a fuel having a permissible compression ratio less than the compression ratio of the new engine, said charge being supplied at a first pressure;

supplying a diluting gas to the intake manifold of the engine at a location near the intake port of a combustion chamber for the engine, said diluting gas being at a second pressure which is higher than said first pressure to dilute a portion of the charge within the intake manifold and to thereby prestratify the charge to be delivered to the combustion chamber;

feeding the diluted portion of the charge followed by a substantially undiluted portion of the charge to the combustion chamber while maintaining stratification to produce and end gas diluted portion of the charge within said combustion chamber at a location remote from the charge ignitor; and igniting said charge to produce a flame front which moves from the ignition point through said combustion chamber to said end gas, the dilution of said end gas due to prestratification producing a reduced temperature in said end gas to prevent detonation.

2. The method of claim 1, wherein the ratio of said second pressure with respect to said first pressure is between about 1.5 and 3.

3. The method of claim 1, wherein said diluting gas is recirculated exhaust gas.

4. The method of claim 1, wherein said diluting gas is air.

5. The method of claim 1, wherein the ratio of said second pressure with respect to said first pressure is sufficient to produce an end gas that burns without knock.

6. A method of controlling combustion in a spark ignited internal combustion engine to allow the engine to operate knock-free on a fuel having an octane rating lower than that required by the engine in the absence of said combustion control, said method of combustion control comprising the steps of:

introducing a charge into an intake manifold of the engine;

introducing a diluent gas into the intake manifold adjacent an intake valve, said diluent gas diluting said charge in a region adjacent the intake valve to prestratify said charge;

introducing said prestratified charge into a cylinder of the engine upon opening of said intake valve while maintaining the stratification of said charge, said portion of said charge diluted with said diluent gas being disposed in said cylinder at a point furthest from a source of ignition;

igniting said charge to cause a flame front to burn through said charge, said portion of said charge containing said diluent gas being the last portion of said charge to burn, said diluent gas being supplied to said charge in sufficient quantity to prevent said diluted portion of said charge from prematurely burning prior to the arrival of said flame front whereby incipient detonation is prevented.

7. A method of controlling a spark ignition internal combustion engine to operate at a high efficiency on a low octane fuel without detonating, said low octane fuel having a permissible compression ratio less than the compression ratio of said engine said method of control comprising the steps of:

delivering a charge to an intake manifold portion of said engine at a first temperature controlling parameter;

diluting a portion of said charge adjacent an intake valve portion of said engine by addition of a diluent gas at a second temperature-controlling parameter to prestratify said charge in said intake manifold while said intake valve is closed;

opening said intake valve to induct said prestratified charge into a cylinder of said engine while maintaining stratification thereof, said diluted portion of said charge being the first to enter said cylinder and being disposed furthest from the charge igniter in said cylinder;

igniting said charge to cause a flame front to burn through said charge, said diluted portion of said charge being prevented from spontaneously combusting by the addition of a sufficient amount of diluent gas whereby incipient detonation is prevented and the engine is caused to operate with increased efficiency on low octane fuel.

8. The method of claim 7, wherein said first temperature controlling parameter is a first pressure, and said second temperature controlling parameter is a second pressure, said second pressure being greater than said first pressure.

9. The method of claim 7, wherein said first temperature controlling parameter is a first volume, and said second temperature controlling parameter is a second volume which displaces a portion of said first volume.

10. A method of operating an internal combustion engine working in the Otto cycle to permit the use of fuels having a permissible compression ratio less than the compression ratio of the engine, the improvement which comprises:

delivering to a combustion chamber of said engine a prestratified charge having a first diluted portion differing in composition from a second relatively undiluted portion, said charge having a pressure $p_o$ in the absence of any dilution at a given power level of said engine said diluted portion being formed by the addition of diluent gas to increase the manifold pressure to a pressure $p_o^*$, said charge being delivered to said combustion chamber while maintaining the prestratification of said portions so that said first diluted portion is delivered to a point in said combustion chamber remote from the spark ignitor thereof, the pressure of said first diluted portion being increased by the introduction of the diluent by the ratio of $p_o^*/p_o$ defined as:

$$\frac{p_o^*}{p_o} = \frac{\eta_{PCR}}{\eta^*(A/F)_{PCR}}\left[\frac{CR^*(q/CvTo)}{(PCR)\frac{q}{CvTo}\frac{1}{\left(\frac{A}{F}+1\right)_{PCR}} + (PCR)^\gamma - (CR^*)^\gamma} - 1\right]$$

where CR* is the prestratification controlled compression ratio for the fuel; $\eta_{PCR}$ is the engine efficiency without prestratification; $(A/F)_{PCR}$ is the air fuel ratio without prestratification; $T_o$ the manifold inlet temperature; Cv is the heat capacity at constant volume for combustion, q the heating value of the fuel; PCR is the permissible compression ratio without prestratification; $\eta^*$ is the engine efficiency with prestratification, and $\gamma$ is the ratio of specific heat at constant pressure to the specific heat at constant volume, and wherein the ratio $p_o^*/p_o$ is caused to be substantially larger than 1.1, whereby the temperature rise of said first diluted portion during compression and combustion is caused to be insufficient to produce knock.

11. A prestratified charge for a working cylinder of an internal combustion engine operating on the Otto cycle, said charge enabling the engine to operate with a fuel having a permissible compression ratio less than the compression ratio of the engine, the charge comprising:

a first substantially undiluted portion having a pressure $p_o$ at a given power level of the engine, a second diluted portion differing in composition from said first portion by the addition of a diluent gas supplied to increase the manifold pressure to $p_o^*$, said second portion forming a region of diluted charge to produce a prestratification of the charge, the pressure of said diluted portion being increased by the addition of diluent gas by the ratio $p_o^*/p_o$ defined as $$\frac{p_o^*}{p_o} = \frac{\eta_{PCR}}{\eta^*(A/F)_{PCR}}\left[\frac{CR^*(q/CvTo)}{(PRC)\frac{q}{CvTo}\frac{}{(A/F+1)_{PCR}} + (PCR)^\gamma - (CR^*)^\gamma} - 1\right]$$

where CR* is the prestratification controlled compression ratio for the fuel, $\eta_{PCR}$ is the engine efficiency without prestratification; PCR is the permissible compression ratio without prestratification, A/F the air fuel ratio without prestratification, Cv the heat capacity of the combustible mixture at constant volume; q the heating value of the fuel; $T_o$ the cylinder inlet or manifold temperature; $\eta^*$ is the engine efficiency with prestratification; and $\gamma$ is the ratio of specific heat at constant pressure to the specific heat at constant volume, and wherein the ratio $p_o^*/p_o$ is caused to be substantially large than 1.1, whereby the engine will operate on said charge without knock.

12. A method of controlling detonation in internal combustion engines working in the Otto cycle to improve engine efficiency, said engine having a predetermined compression ratio, the method comprising:

providing a fuel having a permissible compression ratio substantially lower than that required for detonation-free operation of said internal combustion engine at said engine compression ratio, the pressure rise during a compression stroke in said engine being sufficient normally to cause preignition of said fuel;

supplying a charge of said fuel to the intake manifold of said internal combustion engine at a first pressure $p_o$;

supplying a diluting gas to the intake manifold of the engine at a location near the intake port of each combustion chamber for the engine, said diluting gas being at a second pressure $p_o'$ which is higher than said first pressure $p_o$ to dilute a portion of the charge formed within said intake manifold prior to delivery of the charge to the combustion chamber to thereby prestratify said charge;

feeding the diluted portion of said charge followed by a substantially undiluted portion of said charge to the combustion chamber while maintaining the stratification of said charge, said diluted portion producing a diluted end gas portion of the charge within the combustion chamber at a location remote from the charge igniter; and igniting said charge to produce a flame front which moves from the ignition point through the combustion chamber to the location of said end gas portion, the dilution of said end gas due to prestratification producing a reduced temperature in said end gas to prevent preignition, the second pressure $p_o'$, and thus the amount of dilution, being sufficiently greater than the pressure $p_o$ as to effectively increase the permissible compression ratio of said fuel to about the predetermined compression ratio of said engine, whereby said fuel operates said engine substantially without detonation.

13. The method of claim 12, wherein said second pressure $p_o'$ is between 50% and 200% greater than said first pressure $p_o$.

14. The method of claim 12, wherein said fuel has a permissible compression ratio of approximately 5, and wherein said predetermined engine compression ratio is approximately 8.

15. The method of claim 14, wherein said fuel is kerosene, said engine being normally operative only when said fuel is gasoline.

16. The method claim 13, wherein said fuel has a permissible compression ratio equal to said predetermined engine compression ratio, and further including:

increasing said engine compression ratio to a value substantially greater than said fuel permissible compression ratio to thereby increase the efficiency of said engine.

17. A method of operating a high compression ratio engine with a relatively low octane fuel for improved efficiency and fuel economy, comprising:

providing a fuel having a critical compression ratio, at which spontaneous combustion will occur, which is less than about the compression ratio of the engine to which it is to be supplied, said fuel normally causing preignition in the engine;

supplying a charge of said fuel to the intake manifold of the engine at a first pressure;

supplying a diluting gas to the intake manifold of the engine at a second pressure which is at least 50% higher than said first pressure and at a location to form diluted charge portions within the intake manifold adjacent the intake ports of each combustion chamber prior to delivery of the charge to the corresponding chambers, to thereby prestratify the fuel charge;

feeding the diluted portion of said charge followed by a substantially undiluted portion of said charge to a combustion chamber during the intake stroke thereof while maintaining the stratification of said charge, said diluted portion producing a diluted end gas portion of the charge within the combustion chamber at a location remote from the charge igniter; and igniting said charge to produce a flame front which moves from the ingition point through the combustion chamber to the end gas portion, the dilution of said end gas being sufficient to increase the permissible compression ratio of said fuel charge to a value approximately equal to the compression ratio of the engine, thereby to prevent preignition.

* * * * *